US009453637B1

(12) United States Patent
Biondo

(10) Patent No.: US 9,453,637 B1
(45) Date of Patent: Sep. 27, 2016

(54) ILLUMINATION DEVICE FOR QUICKLY LOCATING AN OBJECT SECURED THERETO

(76) Inventor: Barry Biondo, Lake Worth, FL (US)

( * ) Notice: Subject to any disclaimer, the term of this patent is extended or adjusted under 35 U.S.C. 154(b) by 238 days.

(21) Appl. No.: 13/444,977

(22) Filed: Apr. 12, 2012

(51) Int. Cl.
*F21V 21/00* (2006.01)
*F21V 23/04* (2006.01)
*F21V 21/04* (2006.01)

(52) U.S. Cl.
CPC ..... *F21V 21/04* (2013.01)

(58) Field of Classification Search
CPC .... G01S 17/026; G01S 7/4813; G01S 19/14; G01S 19/17; G01S 19/19; H01H 13/83; H01H 2219/014; H01H 2219/016; H01H 2239/022; H01H 2219/036; Y10T 307/799
USPC ..... 362/103, 104, 153–157, 183, 192, 196, 362/198, 200–205, 249.01, 249.02, 249.08, 362/249.12, 394, 800, 802
See application file for complete search history.

(56) References Cited

U.S. PATENT DOCUMENTS 4,588,387 A * 5/1986 Swenson ..... 446/130
5,236,383 A * 8/1993 Connelly ..... 446/219
5,649,758 A * 7/1997 Dion ..... 362/103
5,888,156 A * 3/1999 Cmiel et al. ..... 473/570
6,152,572 A * 11/2000 Cutler ..... 362/155
7,298,090 B2 * 11/2007 Tseng ..... 315/51
7,404,651 B2 * 7/2008 Long et al. ..... 362/192
7,431,474 B2 * 10/2008 Mah ..... 362/192
8,246,193 B2 * 8/2012 Weng ..... 362/183
8,330,284 B2 * 12/2012 Weston et al. ..... 290/1 R
2005/0261083 A1 * 11/2005 Liao ..... 473/353
2007/0087861 A1 * 4/2007 Liao et al. ..... 473/353
2007/0281811 A1 * 12/2007 Wang ..... 473/570
2009/0147505 A1 * 6/2009 Robinett ..... 362/183
2011/0194276 A1 * 8/2011 Au ..... 362/104
2012/0244969 A1 * 9/2012 Binder ..... 473/570

* cited by examiner

*Primary Examiner* — Hargobind S Sawhney
(74) *Attorney, Agent, or Firm* — Daniel S. Polley, P.A.

(57) ABSTRACT

An illumination device is secured to an object, such as, but not limited to, one or more keys. The illumination device is provided with circuitry such that the bulbs are energized only upon a sufficient shaking force being provided. When the illumination device is located within a purse or carrying bag, shaking of the purse or carrying bag, causes, the illumination device to light up and allow a user to quickly locate his or her keys or other object secured to the illumination device within the purse or carrying bag, amongst the various other objects also contained within the purse or carrying bag.

18 Claims, 2 Drawing Sheets

ILLUMINATION DEVICE FOR QUICKLY LOCATING AN OBJECT SECURED THERETO

1. FIELD OF THE INVENTION

The present invention is generally related to illumination devices and particularly to an illumination device having an object secured wherein the illumination device is used for quickly location of the object.

2. BACKGROUND OF THE INVENTION

Women frequently store their keys in a purse when they are out of their residence. In addition to their keys, many other objects are often stored in the purse at the same time. This often makes locating the keys within the purse difficult unless other items also contained in the purse are removed. The present invention is directed to overcoming the problem of quickly locating one's keys or another object within a purse, bag, handbag, case, enclosure, etc. (collectively referred to as "Portable Enclosure") without first removing other items in the Portable Enclosure.

SUMMARY OF THE INVENTION

The present invention generally provides an illumination device that can be attached or secured to any item or object that one wishes to quickly locate when such item or object (collectively referred to as "Object") is disposed within a Portable Enclosure with other items and objects, and thus, not easily viewable. The illumination device is provided with circuitry, that upon a sufficient shaking force on the Portable Enclosure by the user, power is provided to light up the illumination device or portions of the illumination device and thus make its location within the Portable Enclosure easily identifiable by the user.

DETAILED DESCRIPTION OF THE INVENTION

Figure 2:
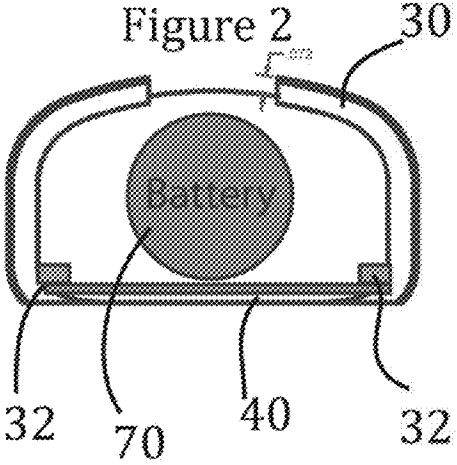
FIG. 2 is an end view of the housing of FIG. 1 with the end removed to reveal inside of the housing.
Figure 3:
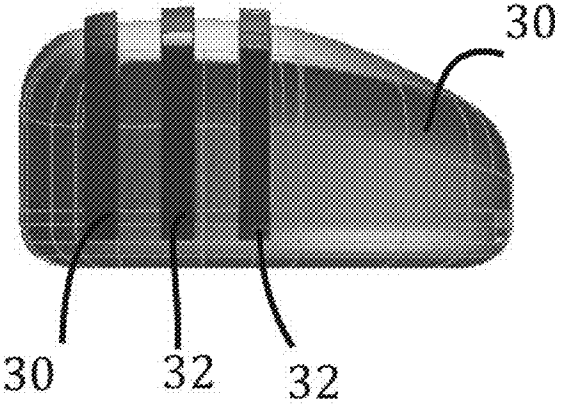
FIG. 3 is side view of the housing of FIG. 1.
Figure 1:
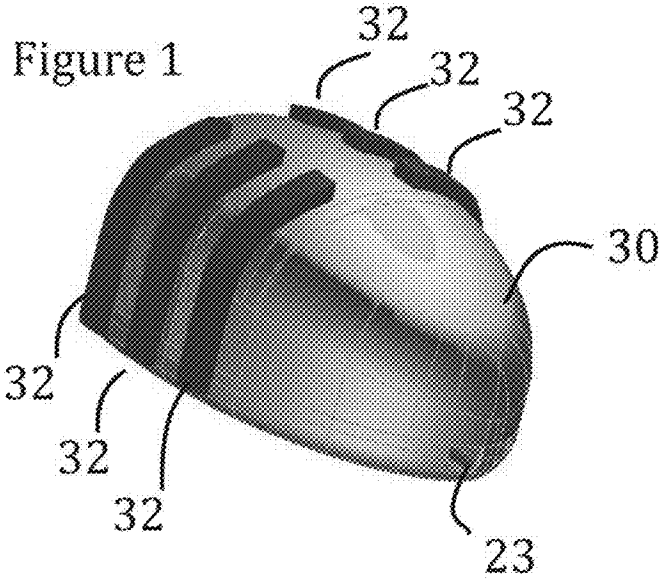
FIG. 1 is a front perspective view of one non-limiting housing embodiment for the illumination device in accordance with the present invention.

As seen in the present invention illumination device is shown and generally designated as illumination device 20. Illumination device 20 includes a housing, which is shown as housing 30. Housing 30 is only one non-limiting configuration, shape, etc. that can be used as the housing for illumination device 20 and the outer housing is not considered limited to any particular shape, configuration, design, material, etc.

A notch 23 or other securement device can be provided in or with housing 30 for securing housing to an Object, such as, but not limited to, a key ring. The Object can be anything, including, but not limited to, one or more keys, key ring, cell phone, wallet, garage remote, makeup, writing device, etc. In its preferred use, illumination device 20, secured to a desired Object, is preferably disposed within the internal storage area of a Portable Enclosure.

One or more ribs 32 can be secured or otherwise connected to housing 30 as the preferred method for viewing light from lights 60, when lights 60 are energized, which will be discussed in detail below. Lights 60 are in electrical communication with the other electrical components (FIG. 4) of an electrical circuit that is used for operation of illumination device 20 in accordance with the present invention. The electrical circuit can be provided as a chip, circuit board, embedded circuit, etc. A battery 70 can be preferably provided as the power source for illumination device 20 and is in electrical communication with the electrical circuit. Battery 70 can be rechargeable or nonrechargeable. Furthermore, housing 30 can be constructed such that one end is removably secured to the rest of housing 30 to allow battery 70 to be accessed and replaced/recharged. In another embodiment, housing 30 is constructed such that it is intended not have any end removably secured, such that the battery is not replaced. Furthermore, if battery 70 is of a chargeable type and a portion of housing 30 is not removable to provide access within housing 70, conventional mechanical or electrical connections/contacts can be provided such that the entire housing can be secured to a recharging device.

Ribs 32 are preferably translucent or transparent such that they permit at least some of the light emulating from lights 60 to be visible therethrough.

Figure 4:
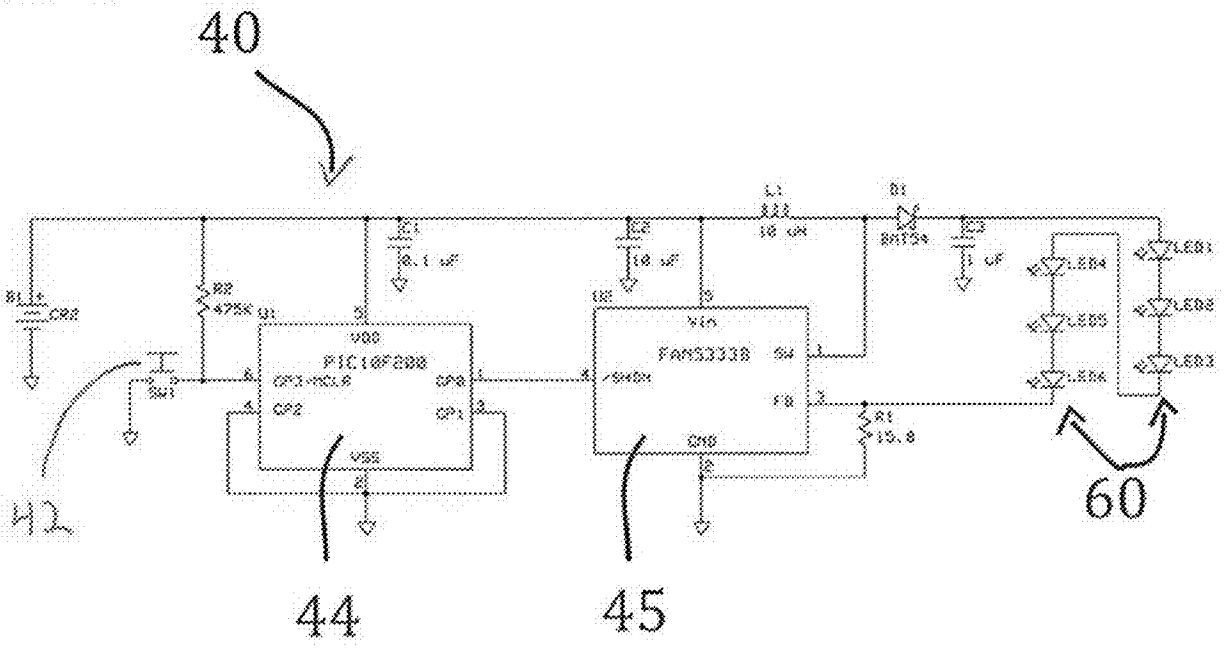
FIG. 4 is one non-limiting electrical schematic for the circuitry of the illumination device in accordance with the present invention.

As best seen in FIG. 4, a non-limiting electrical schematic shows the details for one non-limiting electrical circuit 40 which can be used for operation of illumination device 20. Battery 70 can be provided for supplying current to one or more lights 60. In a non-limiting preferred embodiment, lights 60 can be a plurality of LEDs, such as, but not limited to super bright LEDs. Preferably, though not limiting, the number of lights (LEDs) 60, chosen can correspond to the number of ribs 32 provided in connection with housing 30, such that the LEDs can be arranged within housing 30 in order to light up the preferred translucent ribs 32. Ribs 32 can be preferably manufactured from a material which is capable dissipating and refracting light such that the light is visible from a very broad angle in any direction and thus making lighted ribs 32 visible at any angle.

Circuit 40 preferably includes a shock sensing switch 42 with the remaining portions of the circuit provided to perform the desired functions of illumination device 20. Battery 70 can be capable of supplying a relatively high current to illuminate the preferred super bright LEDs 60. In a non-limiting, preferred embodiment shock sensing switch 42 can be activated when shocked with a minimum or threshold force of 10 Gs or about or substantially 10 Gs. Other minimum or threshold levels can be used for activating shock sensing switch 42 (closing of switch 42) and are all considered within the scope of the invention.

Circuit 40 can also preferably include a mini microprocessor or mini microcontroller 44 (collectively "miniprocessor") that remains in a sleep mode until shock sensing switch 42 is closed by the user exceeding the shock force (i.e. shaking the Portable Enclosure containing the object to be located, etc.). The turning on of circuit 40 can be for any predetermined time interval programmed into miniprocessor 44. Circuit 40 can also be provided with a voltage boosting section in order to achieve the intensity needed to visually locate an item in a dark bag (i.e. Portable Enclosure). Miniprocessor 44 can be programmed and/or configured such that LEDSs 60 flash in a time interval in order to conserve battery power and allow LEDs 60 to be operated at a higher current then rated. The off time of circuit 40 gives LEDs 60 time to cool to preserve their life. High intensity light from LEDs 60 can be dissipated through preferred highly efferent clear ribs 32 preferably located on the sides of housing 30 to optimize the intensity of LEDs 60.

Preferably battery 70 can be a low voltage battery. One novel aspect of circuit 40 is its ability to have LEDs 60 illuminate very bright with low voltage battery 70 (i.e. 3-volts, etc.). In order to preferably extend the life battery 70, circuit 40 can be designed such that power from battery 70 is not required to be drawn at all time. In one non-limiting embodiment, battery life for battery 70 can be extended through firmware used by miniprocessor 44 that can be provided with a unique code. The firmware code instructs miniprocessor 44 to go into a sleep mode drawing very little current when not in use. Upon waking (shocking—exceeding the shaking force—closing of switch 42) miniprocessor 44 can preferably turn on the voltage booster section of circuit 40 such that the boosted voltage is capable of driving the preferred six LEDs 60 at a relatively high current to achieve a very high intensity. In a non-limiting, preferred embodiment, the boosting circuit increases the battery voltage from 3 to 21 volts, contributing to the uniqueness and efficiency of circuit 40.

Miniprocessor 44 can be programmed to energize LEDs 60 for a specific interval of time, such as, but not limited to, about ten seconds, though such is not considered limiting and other smaller or larger time periods can be selected and are considered within the scope of the invention. At the end of programmed "on" time period, point switch 42 can be opened again. Thus, with LEDs 60 energized the Object secured to illumination device 20 can be quickly located in a cluttered Portable Enclosure. Illumination device 20 can be attached or secured to any Object that one wishes to quickly locate within a Portable Enclosure with other items and objects, and thus, not easily viewable. Upon a sufficient shaking force on the Portable Enclosure power is provided to light up or energize LEDs 60 of illumination device 20 and thus make the location of the attached Object within the Portable Enclosure easily identifiable by the user.

In lieu of or in addition to ribs 32, at least a portion of housing 30 can be made from a transparent or translucent material such that the light bulbs (i.e. LEDs) disposed within housing 30 can be seen through housing 30 when they are energized. If no ribs 32 are provided housing 30 can be provided without any apertures for where ribs 32 are normally inserted or disposed.

When using the mini microprocessor with software, the unit can be calibrated when initial supply current is applied (i.e. battery is installed). In one embodiment, when triggered or activated, the lighting pattern can be programmed to flash for a period of time, such as, but not limited to ten second or about ten second.

To increase or extend battery life, the processor is programmed so as to be in a "sleep" mode as much as possible.

In one non-limiting embodiment, the unit can be activated when pin 6 on miniprocessor/microprocessor 44 (i.e. PIC10F200, etc.) goes low. Preferably a spring type switch can be provided for switch 42. Switch 42 can have its sensitivity manufactured into the switch. Upon a sufficient shock like motion a spring member of the switch touches a center rod which temporary brings pin 6 of IC chip 44 to ground to start the flashing process programmed into microprocessor 44. Once completed for the programmed time period, the unit preferably goes into a sleep mode, which assists in conserving battery life. While in a sleep mode, in one embodiment only 2.5 uA are drawn.

When the unit is activated, current supplied to LEDs 60 can be determined by the value of resistor R1. One non-limiting formula that can be used to select the value for resistor R1 can be: Resistor R1 value=300÷desired current. The booster chip 45 (FAN5333B) shown in the schematic can be designed to provide a constant current. In one embodiment, the circuit of the present invention preferably uses about 20 mA in order to achieve a super brightness from LEDs 60, which is another unique feature of the present invention. Booster chip 45 rises the voltage in order to maintain a constant current. In one embodiment, chip 45 permits lighting up to about 3.2 V LEDs in series, as it can boost a 3 volt battery to over 24 volts. It will however draw 120 ma (6 led's×20 ma). The flashing of the led's increase the life of battery 70 and the life of LEDs 60.

In one non-limiting schematic embodiment six LEDs 60 can be provided and connected in series with about 20 mA and a converter efficiency of approximately 80%. In this embodiment, battery 70 should supply approximately 150 mA when LEDs 60 are on (i.e. energized). 150 mA operating for 3.04 hours over the course of the year should use a battery capacity of at least 456 mAh. In one embodiment, battery 70 can be CR2 capable of 850 maH, which should last well over a year in time.

Also for one non-limiting embodiment the following parts can be used for the components values shown in the non-limiting schematic of FIG. 4:

Capacitors
- C1 Kemet C0805C104K5RACTU, 0.1 μF 50V ceramic (0805 package)
- C2 Kemet C0805C106K9PACTU, 10 μF 6.3V ceramic (0805 package)
- C3 Kemet C1210C105K5RACTU, 1 μF 50V ceramic (1210 package)

Diode
- D1 Fairchild BAT54 (SOT-23 package)—switching diode controls the magnetic field of the inductor to boost voltage.

Inductor
- L1 Murata LQH43CN100K03L, 10 pH (1812 package)—Inductor coil boost's voltage as power is turned on and off by the booster chip 45 (i.e. FAN5333)

Lights
- LED 1-6 Harvatek HT-T169NB-5538 Blue LED (PLCC-2 package)—supper bright Blue LEDs (reference number 60)

Resistors
- R1 Xicon 292-15.8-RC (0805 package)—resistor value determines constant current from booster chip 45 (i.e. FAN5333)
- R2 Xicon 292-475K-RC (0805 package)

Activation Mechanism
- Spring/Vibration Sensor Switch 42—Triggers micro processor IC Chips
- U1—Microchip PIC10F200T-I/OT (SOT-23 package)—controls all functions including booster circuit (reference number 44).
- U2—Fairchild FAN5333BSX—Boost voltage to light up 6 LEDs preferably at a constant current, it controls the switching of the diode to collapse the magnetic field of the inductor causing a controlled spike in voltage (reference number 45)

Battery
- CR2 3V Lithium Battery

All locations, sizes, shapes, measurements, amounts, angles, voltages, frequencies, component or part locations, configurations, temperatures, weights, dimensions, values, percentages, materials, orientations, etc. discussed above or shown in the drawings are merely by way of example and are not considered limiting and other locations, sizes, shapes, measurements, amounts, angles, voltages, frequencies, component or part locations, configurations, temperatures, weights, dimensions, values, percentages, materials, orientations etc. can be chosen and used and all are considered within the scope of the invention.

Dimensions of certain parts as shown in the drawings may have been modified and/or exaggerated for the purpose of clarity of illustration and are not considered limiting. Component values shown in the drawings, including the electrical schematics, are merely examples of component values and part numbers that can be used and the present invention is not considered limited to these specific component values and part numbers.

Unless feature(s), part(s), component(s), characteristic(s) or function(s) described in the specification or shown in the drawings for a claim element, claim step or claim term specifically appear in the claim with the claim element, claim step or claim term, then the inventor does not considered such feature(s), part(s), component(s), characteristic(s) or function(s) to be included for the claim element, claim step or claim term in the claim for examination purposes and when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. An illumination device comprising:

a housing having at least one light passage opening;

at least one light bulb disposed within said housing;

a miniprocessor and associated circuitry disposed within said housing and in electrical communication with said at least one light bulb;

a power source disposed within said housing; and a shock sensing switch in electrical communication with said power source and said miniprocessor, said shock sensing switch calibrated to remain open unless a predetermined amount of shaking force is applied by a user;

wherein when said predetermined amount of shaking force has been applied by the user to a portable enclosure where said housing is fully disposed therein and fully enclosed by said portable enclosure said shock sensing switch automatically closes which causes power from said power source to reach said miniprocessor to activate said miniprocessor and to energize said at least one light bulb;

wherein when said at least one light bulb is energized light generated from the at least one light bulb is visible through said one light passage opening;

wherein said at least one light passage opening is a plurality of light passage openings and said illumination device further comprising a plurality of translucent or transparent ribs, each one of said plurality of translucent or transparent ribs disposed within a corresponding one of said plurality of light passage openings to allow light generated within said housing to be externally visible through said plurality of translucent or transparent ribs and refracted in various directions; wherein said at least one light bulb is a plurality LED light bulbs; wherein each from said LED light bulbs aligns with a corresponding rib.

2. The illumination device of claim 1 wherein said miniprocessor is programmed to remain activated for a predetermined period of time.

3. The illumination device of claim 2 wherein upon activation of the miniprocessor said miniprocessor is programmed to cause the at least one light to no off and on in a flashing or blinking pattern during the predetermined period of time.

4. The illumination device of claim 1 wherein said associated circuitry further comprising a voltage booster circuit for increasing the voltage received from the power source prior to receipt by said at least one light bulb.

5. The illumination device of claim 1 wherein said at least one light bulb is at least one LED light bulb.

6. The illumination device of claim 1 wherein said power source is a battery.

7. The illumination device of claim 1, wherein said at least one light bulb is a plurality of LED light bulbs; wherein a number of LED lights bulbs corresponds to a number of ribs provided.

8. The illumination device of claim 1 wherein said object is one or more keys.

9. The illumination device of claim 1 wherein said housing having a rounded top surface and said ribs extending outward from said rounded top surface such that the ribs are not flush with the rounded top surface of said housing.

10. An illumination device comprising:

a housing having at least one light passage opening;

at least one light bulb disposed within said housing;

a miniprocessor and associated circuitry disposed within said housing and in electrical communication with said at least one light bulb;

a power source disposed within said housing; and a shock sensing switch in electrical communication with said power source and said miniprocessor, said shock sensing switch calibrated to remain open unless a predetermined amount of shaking force is applied by a user;

wherein when said predetermined amount of shaking force has been applied by the user to a portable enclosure where said housing is fully disposed therein and fully enclosed by said portable enclosure said shock sensing switch automatically closes which caucuses power from said power source to reach said miniprocessor to activate said miniprocessor and to energize said at least one light bulb;

wherein when said at least one light bulb is energized light generated from the at least one light bulb is visible through said one light passage opening;

wherein said housing having a plurality of light passage openings and a plurality of translucent or transparent ribs filling said plurality of light passage openings;

wherein said housing having a rounded top surface and said ribs extending, outward from said rounded top surface such that the ribs are not flush with the rounded top surface of said housing; wherein said at least one light bulb is a plurality LED light bulbs; wherein each from said LED light bulbs aligns with a corresponding rib.

11. The illumination device of claim 10 wherein a number of LED light bulbs corresponds to a number of ribs provided.

12. The illumination device of claim 10 wherein said associated circuitry comprising a voltage booster circuit, said voltage booster circuit increasing the voltage received from the battery prior to receipt by said at least one light bulb.

13. The illumination, device of claim 10 wherein said miniprocessor is programmed to remain active for a predetermined period of time.

14. The illumination device of claim 13 wherein upon activation of the miniprocessor said miniprocessor is programmed to cause the at least one light to go off and on in a flashing or blinking pattern during the predetermined period of time.

15. The illumination device of claim 10 wherein said object is one or more keys.

16. An illumination device secured to an object and used for finding the object amongst other objects within a portable enclosure, comprising:

a housing having a plurality of light passage openings, said housing having a rounded top surface;

a plurality of translucent or transparent ribs filling said plurality of light passage openings, said ribs extending outward from said rounded top surface such that the ribs are not lush with the rounded top surface of said housing;

a plurality of LED light bulbs disposed within housing;

a miniprocessor and associated circuitry for energizing said plurality of LED light bulbs under certain conditions, said circuitry contained within said housing and in electrical communication with said at least one light bulb;

a battery disposed within said housing;

a shock sensing switch in electrical communication with said battery and said miniprocessor, said shock sensing switch calibrated to remain open unless a predetermined amount of shaking force is applied by a user and with the shock sensing switch in the open position said battery is prevented from powering said miniprocessor;

wherein when said predetermined amount of shaking force has been applied by the user to a portable enclosure where said housing is fully disposed therein and fully enclosed by said portable enclosure said shock sensing switch automatically closes which causes power from said battery to reach said miniprocessor to activate said miniprocessor and to energize said plurality of LED light bulbs both virtually at a same time and both with a same motion by the user;

a voltage booster circuit, said voltage booster circuit increasing the voltage received from the battery prior to receipt by said plurality of LED light bulbs;

wherein when said plurality of LED light bulbs are energized light generated from the plurality of LED light bulbs is externally visible through and refracted in various directions by said plurality of translucent or transparent ribs;

a ring member secured to the post of said housing, said ring member adapted for securement to an object that the user wishes to quickly find amongst other objects located in a portable enclosure;

wherein upon activation of the microprocessor said miniprocessor is programmed to cause the plurality of LED light bulbs to go off and on in a flashing or blinking pattern during the predetermined period of time; wherein said at least one light bulb is a plurality LED light bulbs; wherein each from said LED light bulbs aligns with a corresponding rib.

17. The illumination device of claim 16 wherein said object is one or more keys.

18. The illumination device of claim 16 wherein a number of LED light bulbs corresponds to a number of ribs provided.

* * * * *